United States Patent [19]

Gomes, Jr.

[11] Patent Number: 4,636,604

[45] Date of Patent: Jan. 13, 1987

[54] EMERGENCY IGNITION SHUTOFF SYSTEM

[76] Inventor: Les R. Gomes, Jr., 4634 E. Dakota, Fresno, Calif. 93726

[21] Appl. No.: 768,684

[22] Filed: Aug. 23, 1985

[51] Int. Cl.[4] ..... H01H 17/14

[52] U.S. Cl. ..... 200/331; 200/334

[58] Field of Search ..... 200/331, 334, 153 F; 180/271

[56] References Cited

U.S. PATENT DOCUMENTS 3,938,613 2/1976 Raborn ..... 200/334

4,250,358 2/1981 Gilbertson ..... 200/153 F 4,426,563 1/1984 Grogan ..... 200/334

*Primary Examiner*—Stephen Marcus

*Assistant Examiner*—Renee S. Luebke

[57] ABSTRACT

This invention is a mechanism that includes a toggle switch wired in series with an ignition switch of a racing car; the toggle switch being mounted on a dashboard and attached to one end of a flexible cord slidable through a conduit mounted on the vehicle framework and the other end of the cord, being attached to the rear of the driver's helmet for actuating the toggle switch with sufficient forward movement of the helmet.

1 Claim, 2 Drawing Figures

EMERGENCY IGNITION SHUTOFF SYSTEM

BACKGROUND OF THE INVENTION

1. Field of the Invention

This invention relates to a system for shutting off the ignition system of a racing car in the event of sudden deceleration or a stuck throttle.

When a racing car has a collision, it is imperative that the ignition system of the vehicle be shut off immediately, whether the driver be conscious or not. When a racing car has a stuck throttle, the driver loses control of the vehicle and often cannot reach the dashboard to turn off the vehicle's ignition. Again, it is imperative that the ignition system of the vehicle be shut off promptly to bring the vehicle to a stop.

2. Summary of the Invention

It is the object of this invention to provide a system for shutting off the ignition of a racing car in the event of sudden deceleration, as in a collision, or a stuck throttle, without the active intervention of the driver of the vehicle.

DETAILED DESCRIPTION

Figure 1:
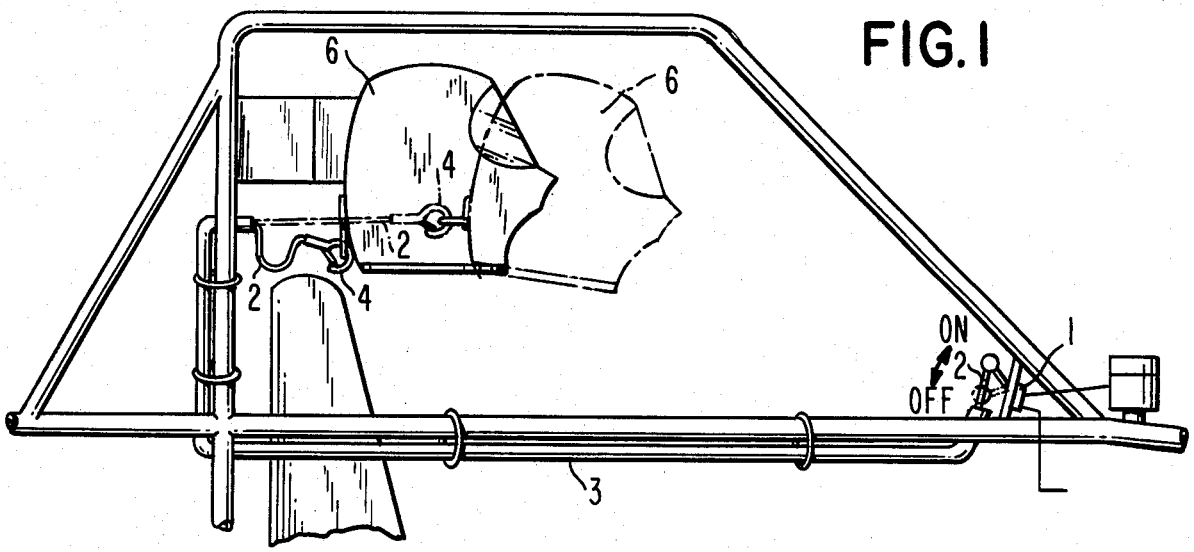
FIG. 1 is a fragmentary side elevational view of an emergency ignition shutoff system in accordance with the present invention.

As illustrated by FIG. 1, a toggle switch 1 mounted on the dashboard of a racing car is wired in series with the vehicle's ignition switch. When the toggle switch 1 is closed, the vehicle may be started and driven. When the toggle switch 1 is open, the vehicle's ignition system is shut off and the compression in the cylinders of the vehicle's engine brings said engine to an immediate stop. A flexible cord 2 is attached at one end to the toggle switch. The flexible cord passes through a tubular conduit 3, in which it slides freely and which passes to the back of the driver's seat. The other end of the flexible cord 2 is attached to a snap hook 4, which hooks into a ring 5 fastened to the back of the driver's crash helmet 6. When during sudden deceleration of the vehicle, the driver is thrown forward, the helmet 6 exerts a pull on the flexible cord 2 via the snap ring 3 and the hook 4. The pull of the flexible cord 2 shuts off toggle switch 1, shutting off the ignition system of the vehicle.

As shown in FIG. 1, the cord is permitted to have a short slack so as to allow the driver to turn his head or move it slightly forward such as during normal driving. However, the slack is limited so as to not allow the helmet to hit the steering wheel or windshield.

Figure 2:
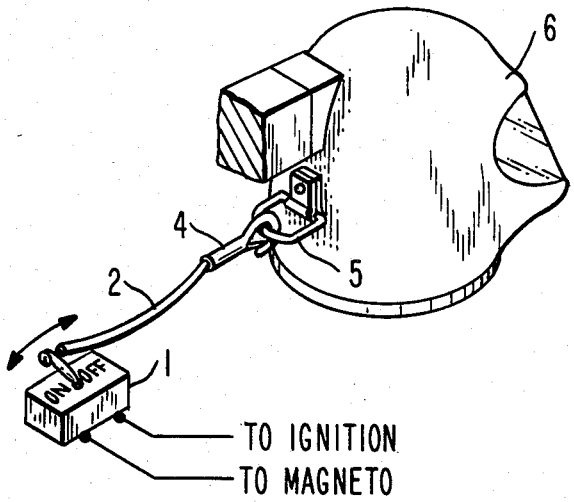
FIG. 2 is a fragmentary perspective view of another installation of the embodiment of the invention.

In an alternative embodiment of the invention, illustrated by FIG. 2, the switch 1 is mounted behind the driver's seat, whereby the motion of the driver's crash helmet during sudden deceleration is directly transmitted by the flexible cord 2 to the toggle switch 1 without the need of a conduit for the flexible cord.

While various changes may be made in the detail construction, it is understood that such changes will be within the spirit and scope of the present invention, as is defined by the appended claim.

What I now claim is:

1. An emergency shut-off mechanism for a racing car having a roll bar framework forming a driver's cage, comprising, in combination, a toggle switch wired in series with an ignition switch of said car, said toggle switch being mounted on a dashboard of said car, one end of a flexible cord being connected to said toggle switch, an "L"-shaped conduit affixed to said driver's cage through which said cord slidably extends, a snap hook affixed to an opposite end of said cord, a ring affixed to a rear portion of a driver's helmet for detachable attachment to said snap hook; said conduit extending from said dashboard to a position rearward of a driver's seat and of said helmet; whereby sufficient movement of the helmet pulls the cord, thereby actuating the switch and shutting off the car.

* * * * *